US008591282B2

(12) United States Patent
Jang

(10) Patent No.: US 8,591,282 B2
(45) Date of Patent: Nov. 26, 2013

(54) DAILY CONTENTS UPDATING TELLER TOY AND METHOD FOR OPERATING THE SAME

(75) Inventor: Soko Jang, Seoul (KR)

(73) Assignee: Sungkyunkwan University Foundation for Corporate Collaboration, Gyeonggi-Do (KR)

( * ) Notice: Subject to any disclaimer, the term of this patent is extended or adjusted under 35 U.S.C. 154(b) by 549 days.

(21) Appl. No.: 12/934,435

(22) PCT Filed: Nov. 28, 2008

(86) PCT No.: PCT/KR2008/007021
§ 371 (c)(1),
(2), (4) Date: Oct. 20, 2010

(87) PCT Pub. No.: WO2009/119959
PCT Pub. Date: Oct. 1, 2009

(65) Prior Publication Data
US 2011/0053455 A1 Mar. 3, 2011

(30) Foreign Application Priority Data
Mar. 28, 2008 (KR) ..... 10-2008-0028851

(51) Int. Cl.
*A63H 3/28* (2006.01)

(52) U.S. Cl.
USPC ..... 446/175; 446/268; 446/484; 704/270; 704/272

(58) Field of Classification Search
USPC ..... 446/175, 484, 268, 297; 704/270, 704/270.1, 272
See application file for complete search history.

(56) References Cited

U.S. PATENT DOCUMENTS

| | | | | |
|---|---|---|---|---|
| 5,615,296 | A | 3/1997 | Stanford et al. | |
| 6,800,013 | B2 * | 10/2004 | Liu | 446/297 |
| 7,068,941 | B2 | 6/2006 | Fong et al. | |
| 8,172,637 | B2 * | 5/2012 | Brown | 446/175 |
| 2008/0160877 | A1 * | 7/2008 | Lipman | 446/268 |

FOREIGN PATENT DOCUMENTS

| | | | |
|---|---|---|---|
| JP | 2002-361585 | A | 12/2002 |
| JP | 2004-236758 | A | 8/2004 |
| KR | 1020010083093 | A | 8/2001 |
| KR | 100332966 | B1 | 5/2002 |

OTHER PUBLICATIONS

WO 01/012285 A1 , Feb. 22, 2011, Networked Toys, Liu, Dexter, 69 pages.*
International Search Report, PCT/KR2008/007021, dated Apr. 29, 2009.
Written Opinion of the International Searching Authority for PCT/KR2008/007021, date of mailing Apr. 29, 2009.

* cited by examiner

*Primary Examiner* — Dmitry Suhol
*Assistant Examiner* — Alex F. R. P. Rada, II
(74) *Attorney, Agent, or Firm* — Hamilton, Brook, Smith & Reynolds, P.C.

(57) ABSTRACT

Provided are an interactive toy whose contents are updated daily, and a method of operating the interactive toy, and more particularly, to an interactive toy in which a wired or wireless communication device and a memory are installed and various contents are downloaded via a web server so as to extract conversation contents from the various contents according to date and other interactive toys and output the extracted conversation contents, and thus allow a user of the interactive toy to engage in conversations with the other users without using an additional conversation contents determining unit, and a method of operating the interactive toy.

7 Claims, 2 Drawing Sheets

DAILY CONTENTS UPDATING TELLER TOY AND METHOD FOR OPERATING THE SAME

This application is the U.S. National Stage of International Application No. PCT/KR2008/007021, filed 28 Nov. 2008, which designates the U.S., published in English, and claims priority under 35 U.S.C. §§119 or 365(c) to Korean Application No. 10-2008-0028851, filed 28 Mar. 2008.

TECHNICAL FIELD

The present invention relates to an interactive toy whose contents are updated daily, and a method of operating the interactive toy, and more particularly, to an interactive toy in which a wired or wireless communication device and a memory are installed and various contents are downloaded via a web server so as to extract conversation contents from the various contents according to date and other interactive toys and output the extracted conversation contents, and thus, allow a user of the interactive toy to engage in conversations with the other users without using an additional conversation contents determining unit, and a method of operating the interactive toy.

BACKGROUND

Toys satisfy children's curiosity and help develop their creativity and sensibility, and thus, toys have been continuously developed for education. Particularly, the educational benefits produced by toys with suitable sound and the created responses of the children to the toys are beneficial to them, and thus, attempts have been constantly made to manufacture toys with such stimulating effects.

At the beginning, cartoon characters were the models to develop toys in order to satisfy children's curiosity, but with time, educational toys were required and this led to the manufacture of toys with predetermined voice chips that function using a touch sensor to express sound and voice. However, since only uniform voice data that is input by the manufacturer can be provided with these toys including sound chips, infants and children who use these toys for a long time get easily bored and thus lose interest and affection for the toys. In other words, toys with conventional voice chips are designed such that voice data is output when the toys are touched or a predetermined part of the toys is pressed. However, the sound made by these touches is only repeated voice messages input by the manufacturer in advance, and thus, infants or children using these toys become easily bored with the repeating output voice messages.

In order to solve the above-described problem, various attempts are being made to manufacture toys while considering the satisfaction of the curiosity of children and meeting educational ends at the same time. In particular, a technique has been developed in which a user's voice input through a predetermined input device is recognized using an input-driven multi-layer perception (IDMLP) neural network algorithm or a conversation determination algorithm, and one voice expression is selected among various voice expressions of a voice scenario corresponding to the recognized voice to output the voice expression via an output device.

However, since conversation of the interactive toys is performed between interactive toys which are registered as friends rather than with a stranger for the first time, the conversation is performed in repeated situations or under limited time. Accordingly, the interactive toys designed based on the above algorithms have increased flexibility according to situations but have also complicated functions and require higher manufacturing costs as compared to the effects.

SUMMARY

The present invention provides an interactive toy whose contents can be updated daily and a method of operating the interactive toy, wherein a wired/wireless communication device and a memory are included in the interactive toy to daily download various contents according to another interactive toy and store the various contents according to date so that the contents can be output to allow a user of the interactive toy to engage in conversations between the interactive toy and another interactive toy, without using an additional conversation contents determining unit.

According to an aspect of the present invention, there is provided an interactive toy whose contents are updated daily, comprising: a unique information unit in which unique information of a user and the interactive toy is stored; a manipulation unit including a plurality of selection keys; a communication unit performing near distance wireless communication between the interactive toy and another interactive toy; a connection unit that is connectable to an external web server and receives contents from the external web server; a storage unit in which unique information of the another interactive toy is stored, wherein the contents from the external web server are stored according to the unique information of the another interactive toy and date in the storage unit; a control unit that controls each of the manipulation unit, the communication unit, the storage unit, the output unit, and the connection unit, stores the contents in the storage unit, updates the contents daily or for predetermined periods, recognizes the another interactive toy and extracts conversation contents corresponding to the another interactive toy from the storage unit according to date; an output unit outputting the extracted conversation contents as a voice or an image; and a power source unit supplying power to the interactive toy.

According to another aspect of the present invention, there is provided a method of operating an interactive toy whose contents are updated daily and which comprises a unique information unit in which unique information of the interactive toy is stored, a storage unit in which contents provided from the external web server are stored according to the unique information and according to date, a communication unit, an output unit, and a control unit, the method comprising: when another interactive toy approaches within a near distance of the interactive toy, receiving unique information of the another interactive toy through the communication unit; determining whether the is another interactive toy is registered in the storage unit by searching for the received unique information of the another interactive toy in the storage unit; if the another interactive toy is determined to be not registered in the storage unit, registering the another interactive toy as a new friend in the storage unit, and outputting contents for the newly registered another interactive toy; if the another interactive toy is determined to be registered otherwise, extracting conversation contents corresponding to the date and the unique information of the another interactive toy from the storage unit and outputting the extracted conversation contents through the output unit; and if the conversation contents corresponding to the date and the unique information of the another interactive toy do not exist in the storage unit, outputting through the output unit a message informing that no corresponding contents are available.

According to the interactive toy of the present invention, various contents can be downloaded and stored in the interactive toy according to date and unique information of another interactive toy, and thus conversation contents extracted from the contents according to another interactive toy can be output according to the date during conversation between the interactive toy and another interactive toy, without using an additional conversation contents determining unit.

Also, since new conversation contents can be downloaded daily, the current season or situations of the present times can be easily reflected in the conversation, thereby satisfying children's curiosity and interests. In addition, various voice expressions reflecting children's senses can help children improve their language skills.

DETAILED DESCRIPTION

The present invention will now be described more fully with reference to the accompanying drawings, in which exemplary embodiments of the invention are shown.

Figure 1:
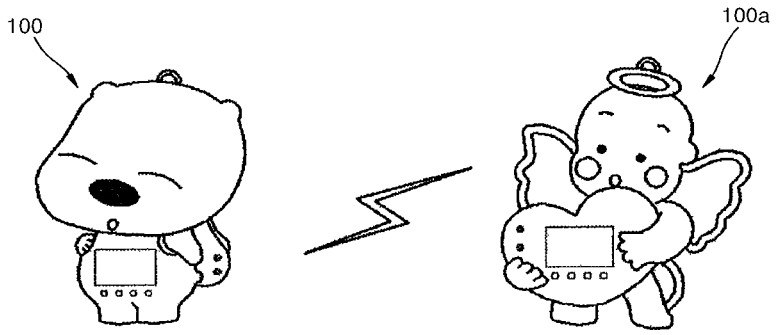
FIG. 1 is a schematic view illustrating an interactive toy that is sensing another interactive toy and outputting conversation contents with the another interactive toy, according to an embodiment of the present invention.

FIG. 1 is a schematic view illustrating an interactive toy 100 that is sensing another interactive toy 100*a* and outputting conversation contents according to an embodiment of the present invention.

The interactive toy 100 includes a near distance wireless communication device. When the interactive toy 100*a* is near the interactive toy 100, unique information of the interactive toy 100 is transmitted to the interactive toy 100*a* and unique information of the interactive toy 100*a* is received from the interactive toy 100*a*. That is, as illustrated in FIG. 1, when another interactive toy such as the interactive toy 100*a* is near the interactive toy 100, their respective unique information is exchanged between the interactive toy 100 and the interactive toy 100*a* using the near distance wireless communication device mounted in each of the interactive toy 100 and the interactive toy 100*a*.

The interactive toy 100 outputs conversation contents corresponding to the interactive toy 100*a* as voice according to the received unique information of the interactive toy 100*a*. The conversation contents are stored and updated daily or for predetermined periods, and output according to date. Accordingly, various conversations can be made between the interactive toy 100 and the interactive toy 100*a* without using an additional conversation contents determining unit. Conversation contents according to the unique information of the interactive toy 100*a* may be voiced as described above. Alternatively, the conversation contents according to the unique information of the interactive toy 100*a* may also be displayed using a display module mounted as an LCD window in the interactive toy 100 and the interactive toy 100*a*.

The interactive toy 100 according to the current embodiment of the present invention transmits and receives unique information to and from other interactive toys such as the interactive toy 100*a* by using a near distance wireless communication method. The near distance wireless communication method may be various according to the usage and purpose. In the current embodiment, a near distance wireless communication method that uses a ZigBee module may preferably be used.

Figure 2:
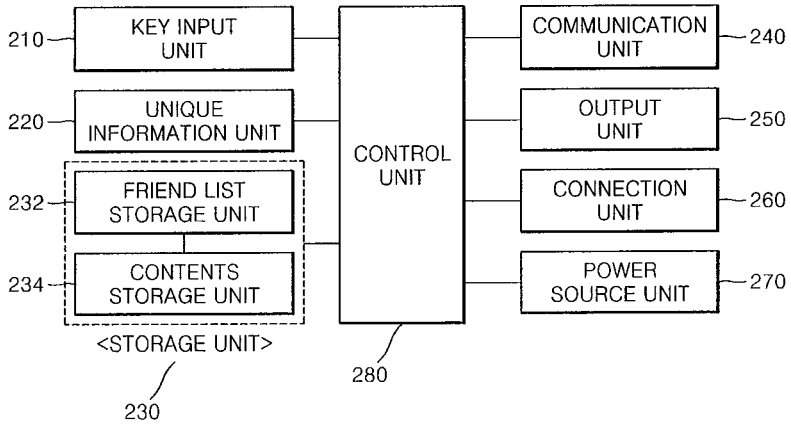
FIG. 2 is a block diagram illustrating the inner configuration of the interactive toy of FIG. 1, according to an embodiment of the present invention.

FIG. 2 is a block diagram illustrating the inner configuration of the interactive toy according to an embodiment of the present invention.

Referring to FIG. 2, the interactive toy 100 includes a unique information unit 220 in which unique information of the interactive toy 100 and its user is stored, a is manipulation unit 210 including a plurality of selection keys, a communication unit 240 performing near distance wireless communication with the interactive toy 100*a*, a connection unit 260 that is connectable to an external web server via network and receives various contents including conversation contents from the external web server, a storage unit 230 in which unique information of other interactive toys which are registered in a friend list are stored and the various contents received from the external web server are stored according to date and according to the unique information of other interactive toys, a control unit 280 that controls each of the above units and recognizes the interactive toy 100*a* to extract conversation contents according to date and the unique information from the storage unit, an output unit 250 outputting the extracted conversation contents as a voice or an image, and a power source unit 270 supplying operational power to each of the above units.

First, the unique information unit 220 stores unique information. The unique information includes a unique ID and user information of the interactive toy 100. The unique information unit 220 provides differential information when another interactive toy 100*a* is recognized through the communication unit 240.

The manipulation unit 210 includes the plurality of selection keys and transmits remote input signals to the control unit 280 via the key input of the user. The manipulation unit 210 includes an output button selecting an output function and a power button for operating the interactive toy 100.

The storage unit 230 includes a friend list storage unit 232 storing unique information of other interactive toys registered as a friend and a contents storage unit 234 storing conversation contents, which are provided from an external web server through the connection unit 260, according to date. The contents storage unit 234 includes conversation contents stored according to respective interactive toys registered in the friend list storage unit 232 and according to date, and the conversation contents are updated daily or for predetermined periods.

Also, additional conversation contents are stored for newly registered interactive toys so as to output different conversation contents according to each of the recognized interactive toys. Various voice and image contents other than the conversation contents between the interactive toys are stored and may be output to the user.

The storage unit 230 may be an embedded memory such as a hard disk or a flash memory, or may be mounted inside the interactive toy 100 as a mobile memory such as a compact flash (CF) card, a secure digital (SD) card, a smart media (SM) card, a multi-media card (MMC), or a memory stick, or may be mounted in a separate device.

The output unit 250 may be realized as a speaker outputting voice or a display apparatus displaying images, and output daily contents stored in the storage unit 230 as a voice or an image. Consequently, the output unit 250 includes all types of output units that output predetermined information, such as a speaker and a display apparatus.

The connection unit 260 makes connection of the interactive toy 100 to a personal computer (PC) easy, and includes at least one of a USB jack, a UART (Serial), an ear phone jack, and a 24-pin jack to be connected to the PC via wires.

The communication unit 240 recognizes the interactive toy 100*a* that is within a near distance of the interactive toy 100, and transmits unique information stored in the unique information unit 220 of the interactive toy 100 to the interactive toy 100*a*. The communication unit 240 of the interactive toy 100 according to the current embodiment of the present invention may use various types of near distance wireless communication methods according the usage and purpose. In the current embodiment, a near distance wireless communication method that uses a ZigBee module may preferably be used.

The control unit 280 controls each of the above units, and outputs conversation contents stored in the storage unit 230 according to the unique information of the another approaching interactive toy, which is obtained through the communication unit 240 and according to date. Also, the control unit 280 includes a real-time clock (RTC) and a timer to control time by itself to update date information daily, and outputs a warning sound through the output unit 250 to inform the user of the necessity of updating the contents for every preset period.

Figure 3:
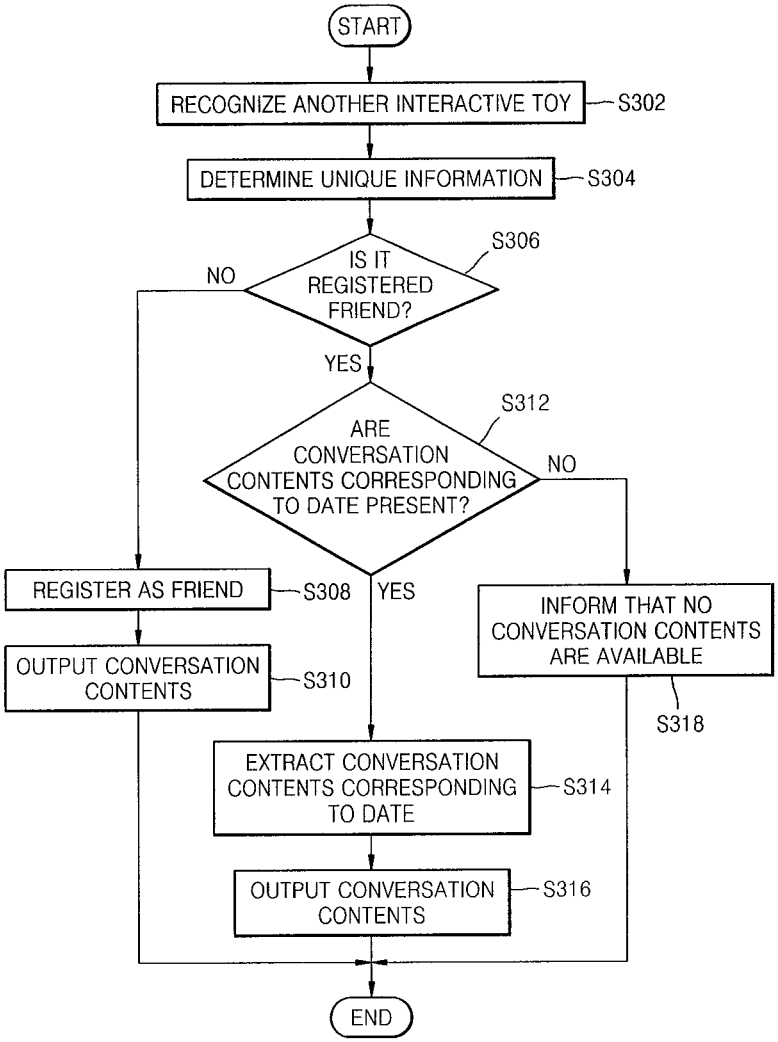
FIG. 3 is a flowchart illustrating a method of outputting conversation contents by the interactive toy of FIG. 1, according to an embodiment of the present invention.

FIG. 3 is a flowchart illustrating a method of outputting conversation contents, according to an embodiment of the present invention.

First, when the interactive toy 100*a* approaches within a near distance of the interactive toy 100, both of interactive toys exchange their respective unique information stored in the unique information unit 220 through the communication unit 240 with each other, in operation S302. Then, in operation S304, the received unique information of the interactive toy 100*a* is searched for in the friend list storage unit 232, and in operation S306, whether the interactive toy 100*a* is registered in advance is determined.

If the interactive toy 100*a* is determined to be not registered, the interactive toy 100*a* will be registered as a new friend by storing the unique information of the interactive toy 100*a* in the friend list storage unit 232, in operation S308. And is conversation contents for the registered interactive toy 100*a* are output through the output unit 250, in operation S310.

On the other hand, if the interactive toy 100*a* is determined to be previously registered, whether conversation contents corresponding to the date for the interactive toy 100*a* exist in the interactive toy 100 is determined, in operation S312. And if conversation contents corresponding to the date exist in the interactive toy 100, the conversation contents are extracted from the storage unit 234 of the interactive toy 100, in operation S314. And the extracted conversation contents are output through the output unit 250 of the interactive toy 100, in operation S316. When a time preset by the timer is reached, the control unit 280 of the interactive toy 100 outputs a warning sound through the output unit 250 to inform the user of the necessity of updating contents. Otherwise, if conversation contents corresponding to the date are not available, the control unit 280 of the interactive toy 100 informs the user of the fact that conversation contents corresponding to the date are not available, in operation S318, so that conversation contents are not output twice. Accordingly, the interactive toy 100 can output different conversation contents according to other interactive toys and according to date, without using an additional conversation contents determining unit.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. An interactive toy whose contents are updated daily, comprising:

a unique information unit in which unique information of a user and the interactive toy is stored;

a manipulation unit including a plurality of selection keys;

a communication unit performing near distance wireless communication between the interactive toy and another interactive toy;

a connection unit that is connectable to an external web server and receives contents from the external web server;

a storage unit in which unique information of the another interactive toy is stored, wherein the contents from the external web server are stored according to the unique information of the another interactive toy and date in the storage unit;

a control unit that controls each of the manipulation unit, the communication unit, the storage unit, the output unit, and the connection unit, stores the contents in the storage unit, updates the contents daily or for predetermined periods, recognizes the another interactive toy and extracts conversation contents corresponding to the another interactive toy from the storage unit according to date;

an output unit outputting the extracted conversation contents as a voice or an image; and a power source unit supplying power to the interactive toy;

wherein the storage unit comprises:

a friend list storage unit which stores the unique information of the another interactive toy that is registered as a friend; and a contents storage unit which stores the contents provided from the external web server via the connection unit, according to date.

2. The interactive toy of claim 1, wherein when recognizing the another interactive toy, the unique information unit provides differential information according to the another interactive toy.

3. The interactive toy of claim 1, wherein the contents are stored in the contents storage unit according to the another interactive toy registered in the friend list storage unit.

4. The interactive toy of claim 1, wherein the contents corresponding to a date or a predetermined period are stored in the contents storage unit according to date.

5. The interactive toy of claim 1, wherein the control unit includes a timer to output a warning sound through the output unit to inform the user of the necessity of updating contents for every preset period.

6. A method of operating an interactive toy whose contents are updated daily and which comprises a unique information unit in which unique information of the interactive toy is stored, a storage unit in which contents provided from the external web server are stored according to the unique information and according to date, a communication unit, an output unit, and a control unit, the method comprising:

when another interactive toy approaches within a near distance of the interactive toy, receiving unique information of the another interactive toy through the communication unit;

determining whether the another interactive toy is registered in the storage unit by searching for the received unique information of the another interactive toy in the storage unit;

if the another interactive toy is determined to be not registered in the storage unit, registering the another interactive toy as a new friend in the storage unit, and outputting contents for the newly registered another interactive toy;

if the another interactive toy is determined to be registered otherwise, extracting conversation contents corresponding to the date and the unique information of the another interactive toy from the storage unit and outputting the extracted conversation contents through the output unit; and if the conversation contents corresponding to the date and the unique information of the another interactive toy do not exist in the storage unit, outputting through the output unit a message informing that no corresponding contents are available.

7. The method of claim 6, wherein regardless of whether or not the another interactive toy is recognized, when a time preset by the timer is reached, outputting through the output unit a warning sound informing a necessity of updating contents.

* * * * *